US005681102A

United States Patent [19]

Forsgren

[11] Patent Number: 5,681,102

[45] Date of Patent: Oct. 28, 1997

[54] CASSETTE FOR THE CONSTRUCTION OF DRAWER CABINETS

[75] Inventor: Stellan Forsgren, Lycksele, Sweden

[73] Assignee: Borgstroms Platindustri AB, Kilafaors, Sweden

[21] Appl. No.: 646,349

[22] PCT Filed: Oct. 18, 1994

[86] PCT No.: PCT/SE94/00974

§ 371 Date: May 10, 1996

§ 102(e) Date: May 10, 1996

[87] PCT Pub. No.: WO95/13725

PCT Pub. Date: May 26, 1995

[30] Foreign Application Priority Data

Nov. 16, 1993 [SE] Sweden ..... 9303798

[51] Int. Cl.[6] ..... A47B 88/00

[52] U.S. Cl. ..... 312/334.1; 312/334.19; 312/334.18; 312/334.7

[58] Field of Search ..... 312/334.1, 334.7, 312/334.4, 334.16, 334.18, 334.19

[56] References Cited

U.S. PATENT DOCUMENTS

| | | | |
|---|---|---|---|
| 2,212,191 | 8/1940 | Dietz | 312/334.18 |
| 2,328,835 | 9/1943 | Motter . | |
| 2,496,997 | 2/1950 | Hallberg | 312/334.7 X |
| 2,815,649 | 12/1957 | Di Angelus et al. | 312/334.4 X |
| 2,898,159 | 8/1959 | Arnit | 312/334.19 X |
| 3,328,106 | 6/1967 | Mullin | 312/334.7 |
| 3,826,554 | 7/1974 | Cornell | 312/334.19 X |

FOREIGN PATENT DOCUMENTS

| | | | |
|---|---|---|---|
| 390843 | 9/1989 | Germany . | |
| 441655 | 1/1968 | Switzerland . | |
| 546553 | 3/1974 | Switzerland . | |
| 560026 | 3/1975 | Switzerland . | |
| 564438 | 9/1944 | United Kingdom | 312/334.7 |
| 1582894 | 1/1981 | United Kingdom | 312/334.4 |
| 8805639 | 8/1988 | WIPO . | |

*Primary Examiner*—Peter M. Cuomo
*Assistant Examiner*—Hank V. Tran
*Attorney, Agent, or Firm*—Young & Thompson

[57] ABSTRACT

A kit is provided for cassettes for a drawer cabinet. The kit includes two pairs or guide rails (28, 28'; 29, 29') which are provided as supplements and are mountable when so required. A first U-shaped rail (28, 28') is connectable at a rear end with the cassette (1), in the area of the rear wall (10) of the latter, and at a front end with the frontal frame (6) of the cassette. At its front end, the first rail has a roller (34) located at a level beneath the lower one (31) of two U-forming flanges. A second rail (29, 29') is at opposite, front and rear ends connectable to a side part (25, 25') of a drawer (5) for use with the cassette. This rail has on one hand a longitudinal, projecting flange (37) arranged to abut against the roller (34) of the first rail, and on the other hand a roller (40) at its rear end arranged to engage between the flanges (31, 31') of the U-rail. A cassette for a drawer cabinet includes similarly designed pairs of guide rails.

3 Claims, 4 Drawing Sheets

CASSETTE FOR THE CONSTRUCTION OF DRAWER CABINETS

TECHNICAL FIELD OF THE INVENTION

The present invention relates to a cassette for the construction of a drawer cabinet, the cassette being of the sort that accommodates a drawer and comprises on one hand a rectangular frontal frame from which four walls extend, viz. a bottom wall, two side walls and an upper wall, and on the other hand a rear wall to which said walls are connected, and which frontal frame has substantially vertically positioned flanges in connection with said walls, the drawer in addition to a frontal frame comprising a bottom part, two side parts and a rear part the height of which is greater than the height of the side parts so as to secure that the upper portion of the rear part engages behind the upper flange of the frontal frame and retains the drawer in its position maximally pulled-out from the cassette.

PRIOR ART

A cassette for a drawer cabinet of the sort generally described above is previously known from DE-A-3 905 843. In its basic embodiment, the individual cassette is provided with four male-like members on its underside, in the form of hook-shaped plates or sheet portions intended to be inserted and locked in cooperating holes in the upper side of a subjacent cassette. The cassettes are commercially available in different embodiments, in particular in embodiments with different heights, thereby enabling the user to erect drawer cabinets adapted to individual needs in a quick and flexible way. In the known cassette for drawer cabinets, the drawer is normally arranged to be guided by two guide rails which are placed on both sides of the drawer adjacent to on one hand each side wall and on the other hand to the bottom wall. According to this embodiment, the drawer is retained in its position within the cassette by two projecting members which are formed on the underside of the bottom part of the drawer, in the vicinity of the frontal part of the drawer, in order to be locked behind a lower part of the frontal frame of the cassette as long as the drawer rests upon the cooperating guide rails. Only when lifting the frontal end of the drawer, so that the projecting members pass clear of the lower part of the frontal frame, the drawer can be pulled out in a direction out of the cassette. In its maximally pulled-out position, the drawer is retained in the cassette by an upper edge portion of the rear part of the drawer that engages behind an upper part comprised in the frontal frame of the cassette. For a complete removal of the drawer from the cassette, the frontal portion of the drawer is turned in an upward direction when the drawer is in the region of its maximally pulled-out position.

Further, FIG. 19 to 21 in DE-A-3 905 843 illustrate a special embodiment according to which an individual selected cassette may be supplemented by a special kit including rolls in order to simplify the pulling out and the pushing in of the drawer relative to the cassette. This kit comprises on one hand two analogous, although mirror-inverted runway tracks which are mountable in the space between an individual side wall of the cassette and a fixed guide rail located at a distance from the inside of said wall, and on the other hand an angle-shaped corner shoe which on its outside carries a rotatable pulley or roller and which is intended to be placed on the outside of each rear corner of the drawer. More precisely, the corner shoe is formed in such a way that it may be applied on a rear corner of the drawer while the drawer is in the cassette, viz. in a half pulled out position, the shoe being held in its position after application of a screw which is insertable from the inside via a hole in a side piece of the drawer. The fact that the drawer is still in the cassette when the roller-bearing corner shoe is fastened on the drawer is an absolute condition for this construction at all being capable of being used, since the roller after having been mounted will protrude to a certain degree from the adjacent side part of the drawer; a fact making it impossible for the roller to pass past the frontal frame of the cassette. An advantage of this embodiment is that the drawer of the particular drawer cabinet becomes smoothly movable when pulling it in or pushing it out also in case the drawer contains heavy objects. However, an important disadvantage of the kit as shown in FIG. 19 to 21 in DE-A-3 905 843 is that it requires a demounting of the cassettes in an existing drawer cabinet in that the corner shoes provided with rollers may only be inserted through the hole present in the upper wall of the cassette. In practice, such a demounting of the cassettes is very cumbersome to accomplish since the drawer cabinets cooperate intimately with other components, such as side-arranged drawer cabinets and/or cassettes as well as superjacent work benches.

OBJECTS AND FEATURES OF THE INVENTION

The present invention aims at eliminating the above-mentioned disadvantage of the previously known construction and providing a cassette making possible a later inclusion of pulleys or rollers for facilitating the movements of the drawer in a cassette without any necessity of removing the latter from an existing, already built-up drawer cabinet. Thus, a primary object of the present invention is to enable a mounting of such rollers by simple means which may be applied in the cassette and on the drawer, respectively, when the drawer is removed from the cassette. According to the invention this object is attained by the features defined in the characterizing clause the claim.

FURTHER ELUCIDATION OF THE PRIOR ART

CH 441 655 discloses a guide rail arrangement using two pairs of cooperating rails, each pair comprising a fixed rail having a first roller as well as a displaceable or movable rail having a second roller. The fixed roller of this arrangement is, however, located with its upper half at a level above the lower flange of the fixed rail, and furthermore the centre axis of the movable roller is situated approximately level with an upper flange of the movable rail. This means that the upwardly protruding fixed roller makes it impossible to insert the movable roller linearly in the guide formed by the two spaced-apart flanges of the fixed rail. Therefore, the arrangement cannot be used for cassettes of the type to which the invention relates.

Guide rail arrangements are also known by CH 546 553 and CH 560 026, but these arrangements call for rollers which are movable along the guide rails, such movable rollers making the arrangements unreliable.

BRIEF DESCRIPTION OF THE ATTACHED DRAWINGS

In the drawings:

FIG. 1 a simplified perspective view illustrating a drawer cabinet in a first embodiment, built up of several cassettes containing drawers, FIG. 2 is an analogous perspective view showing another embodiment of such a drawer cabinet, FIG. 3 a perspective view of an individual cassette with the appurtenant drawer shown in a pushed-in position, FIG. 4 is a perspective exploded view with the drawer separate from the cassette and with a number of the guide rails included in a kit, said rails being shown in connection with the drawer, FIG. 5 is a perspective view of the cassette with the drawer fully pulled out, FIG. 6 is a perspective view of the cassette illustrated from below, and FIG. 7 is a partial, enlarged perspective view showing the interior of the cassette.

In FIG. 1 reference numeral 1 designates individual cassettes which are stacked into a drawer cabinet which is designated by 2 in its entirety. As may be seen in FIG. 2, the lowermost cassette 1 may be mounted on a special bottom frame 3 which is suited for being connected to the underlying floor or support. The uppermost cassette of the drawer cabinet may be covered by a special cover plate 4 or by a longer table which may be supported on two or several drawer cabinets (not shown).

In FIGS. 3 and 4, reference numeral 5 generally designates the drawer that is included in each cassette 1. The cassette 1 as such is composed of a frontal frame, in its entirety designated 6, which delimits a frontal opening 7 for the reception of drawer 5, and a rear part, in its entirety designated 8. This rear part comprises two side walls 9, 9' and a rear wall 10. In practice, the rear part 8 may be made of one single continuous, suitably thin-walled piece of sheet-metal which is punched out of a material and is bent into a U-shape as seen in a cross-section as well as in contour. More precisely, by this shape both upper horizontal flanges 11 and lower, equally horizontal flanges 12 (see FIG. 6) are formed along each one of walls 9, 9' and 10. Said upper flanges 11 are situated in a common plane and form an upper wall or part of the cassette 1. In an analogous way, also the lower flanges 12 are situated in a common horizontal plane and form a lower wall or part of the cassette. The free ends of the U-profiles that are formed by side walls 9, 9' embrace the frontal frame 6 and are connected to it in a suitable manner, for instance by spot welding or pressing. Advantageously, also frontal frame 6 is made of thin sheet-metal which is given a U-shaped cross-section by punching and bending. In FIG. 4 reference numeral 13 designates an upper part, 14 a bottom part and 15,15' vertical side parts included in said frontal frame. Each one of these four front parts 13, 14, 15 and 15' comprises a vertically positioned flange 16. Along the lower flanges 12 of the side walls 9,9' sheet-metal plates 17 of L-formed cross-section are arranged which form fixed guide rails of standard character for the drawer 5. Thus, in its standard embodiment drawer 5 is movable forwardly and backwardly along guide rails 17 while being guided by the vertical flanges 18 of the guide rails.

Further, in FIGS. 3 to 6 may be seen that the bottom side of each cassette is provided with four male-like projections 19 in the form of hook-shaped sheet-metal tabs which can be brought into engagement with corresponding, elongate holes 20 in the upper flanges 11 of a subjacent cassette. When male projections 19 have been brought into engagement with holes 20 and two connected cassettes have been placed so that they are located in register with each other in one and the same vertical plane, then the cassettes may be locked relative to each other by locking a member 21 in the form of a thread-like finger whose free end may be brought into engagement with an analogous hole 22 via an elongate hole in the horizontal web of frontal bottom part 14, hole 22 being in the horizontal web of the frontal upper part in each subjacent cassette. Any horizontal dislocation of the cassettes relative to each other is impeded by locking finger 21, thus safely joining the cassettes and forming a form-stable drawer cabinet.

Referring to FIG. 4, it should be noted that drawer 5 in addition to a frontal part which is designated 23 in its entirety, comprises a bottom part 24, two side parts 25, 25' and a rear part 26. Together, these components form a substantially parallelepipedical drawer. It should be noted that the frontal part or frontal plate is larger than the rear part 26 which is only slightly narrower than the frontal opening 7, whereby frontal part 23 will substantially completely cover the frontal frame 6 when the drawer is in its pushed-in position.

The cassette construction according to FIGS. 3 to 6 described so far is substantially the same as the one disclosed in DE-A-3 905 843.

Detailed description of a preferred embodiment of the invention

Figure 2:
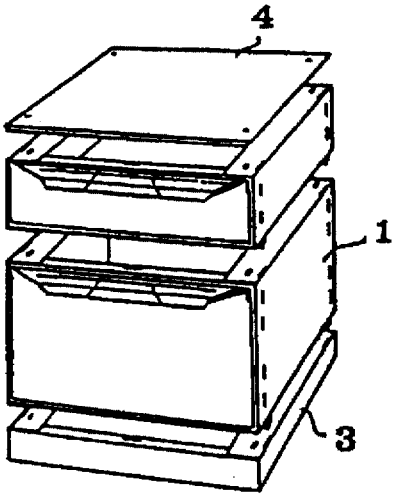
Figure 1:
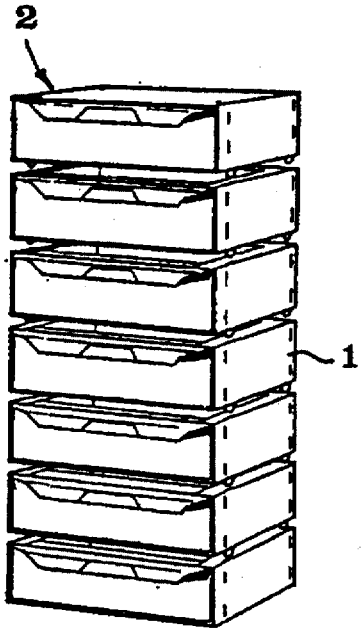
Figure 3:
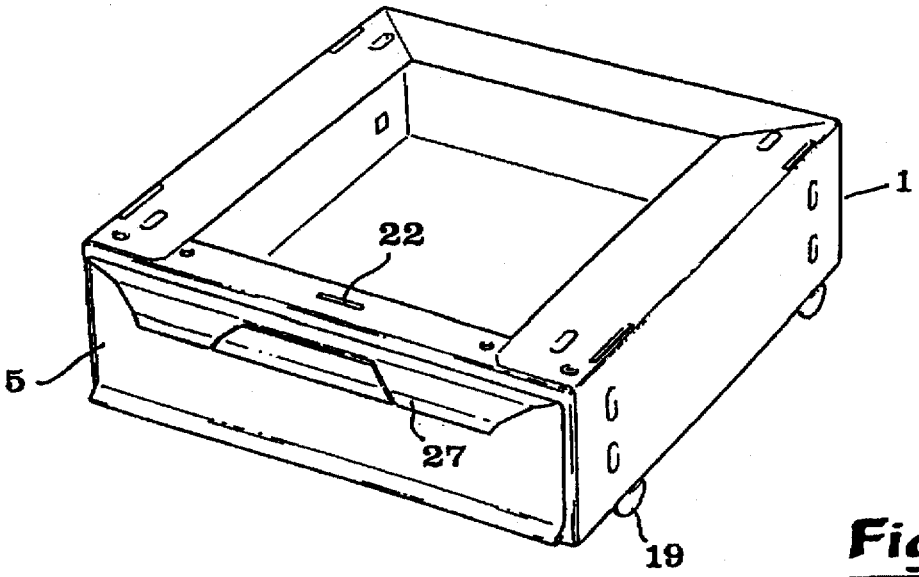
Figure 4:
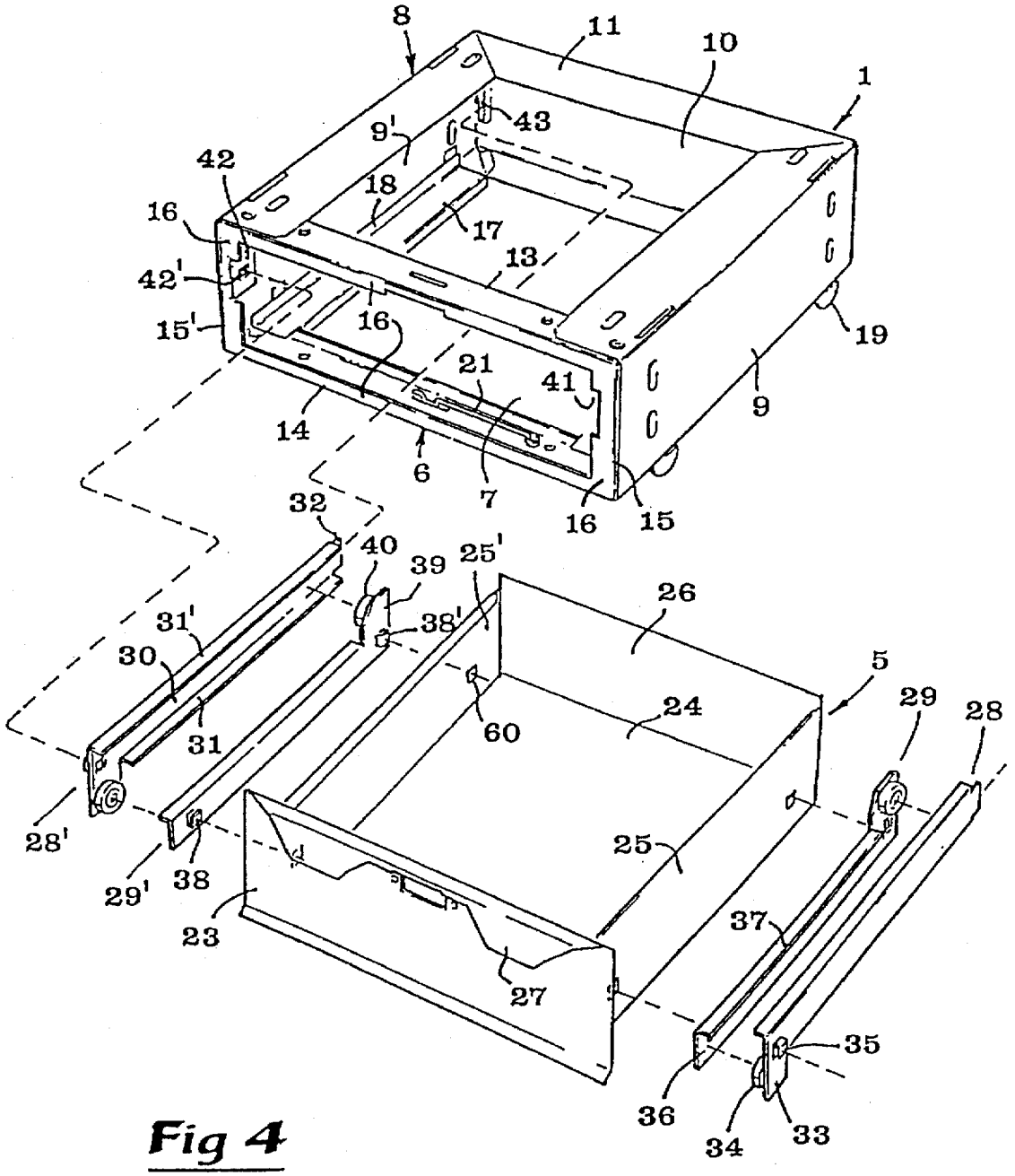

Now particular reference is made to FIG. 4 which illustrates a kit comprising two pairs of guide rails 28,28' and 29,29' which are formed as supplements that are mountable when required. Of these, the former ones 28,28' are intended to be mounted within the cassette 1, viz. adjacent to its side walls 9,9', while the other two guide rails 29,29' are intended to be mounted outside the side parts 25,25' of drawer 5. More precisely, rails 28,29 cooperate in a right-mounted pair, while rails 28',29' cooperate in a left-mounted pair. Each first rail 28,28' has a substantially U-shaped cross-section in that it comprises a plane web 30 from which project two separate, longitudinal and parallel flanges 31,31' of which the former forms an under-flange and the latter an upper-flange. At the inner or rear end of the rail, web 30 is somewhat longer than the flanges, whereby an end part 32 of the web will protrude a distance past the rear ends of flanges 31,31'. At its outer or front end, rail 28 has an angled portion 33 on which a rotatable pulley or roller 34 is mounted in a suitable manner. Furthermore, in immediate proximity to the front end of web 30 a sheet-metal tab 35 is punched out, whose longitudinal extension is substantially perpendicular to the axial extension of the rail. It should be noted that sheet tab 35, which serves as a hook member, projects from the outside of the web, while roller 34 is mounted on the inside of angled portion 33.

Each second guide rail 29,29' comprises an elongate, vertical web part 36 which at its upper edge transposes into a longitudinal, angled flange 37. At the area of the front end of web 36, a sheet-metal tab 38 is punched out, which extends across the longitudinal extension of the rail. An analogous tab 38' which serves as a hook member, is punched out at the rear end of the rail, but that tab 38' extends parallel to the longitudinal extension of the rail. Both tabs 38,38' project from that inner side of the rail which is intended to be placed against corresponding drawer 5. At its rear end, guide rail 29,29' also has an upwardly projecting, lateral sheet-metal portion 39 on which is mounted a rotatable pulley or roller 40.

Figure 7:
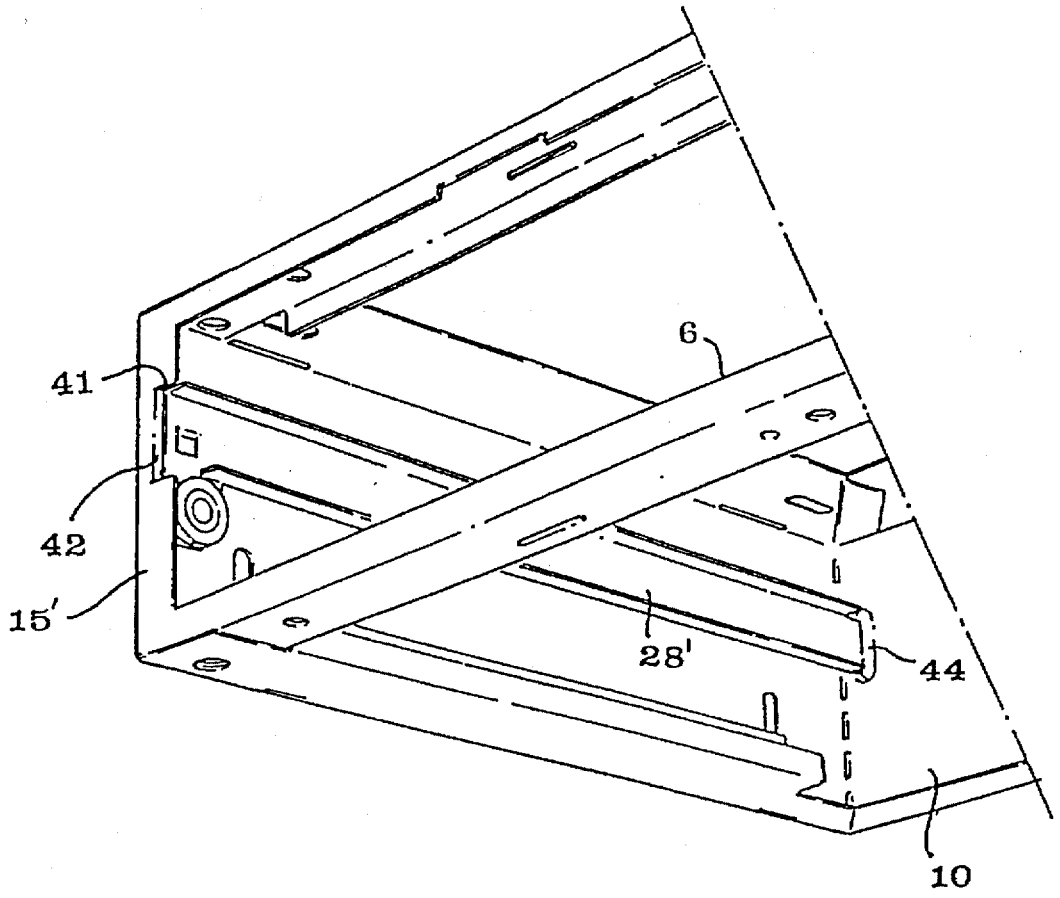

As may be seen in FIGS. 4 and 7, recesses 41 are formed in the vertical side flanges 16 of the vertical side parts 15,15' of the frontal frame 6, adjacent to which recesses extends an inwardly projecting sheet-metal tab 42 in which there is a hole 42' for accommodating the hook member 35 of the first guide rails 28,28'. Elongate, vertically positioned holes 43 are provided in the rear wall 10 of the cassette. These holes have been taken up in connection with inwardly cambered portions 44 of the sheet-metal, whereby the sheet-metal edges that delimit the hole are located at a certain distance inside the plane in which the plate in the rear wall 10 is located. As may be seen in FIGS. 4 and 7, the form and size of the recesses 41 substantially correspond to the cross-sectional form and size of the first guide rails 28, 28'.

In the side walls 25 and 25' of the drawer 5 holes 60 are provided for accommodating the hook-formed sheet-metal tabs 38,38' of the guide rails 29,29'.

Figure 5:
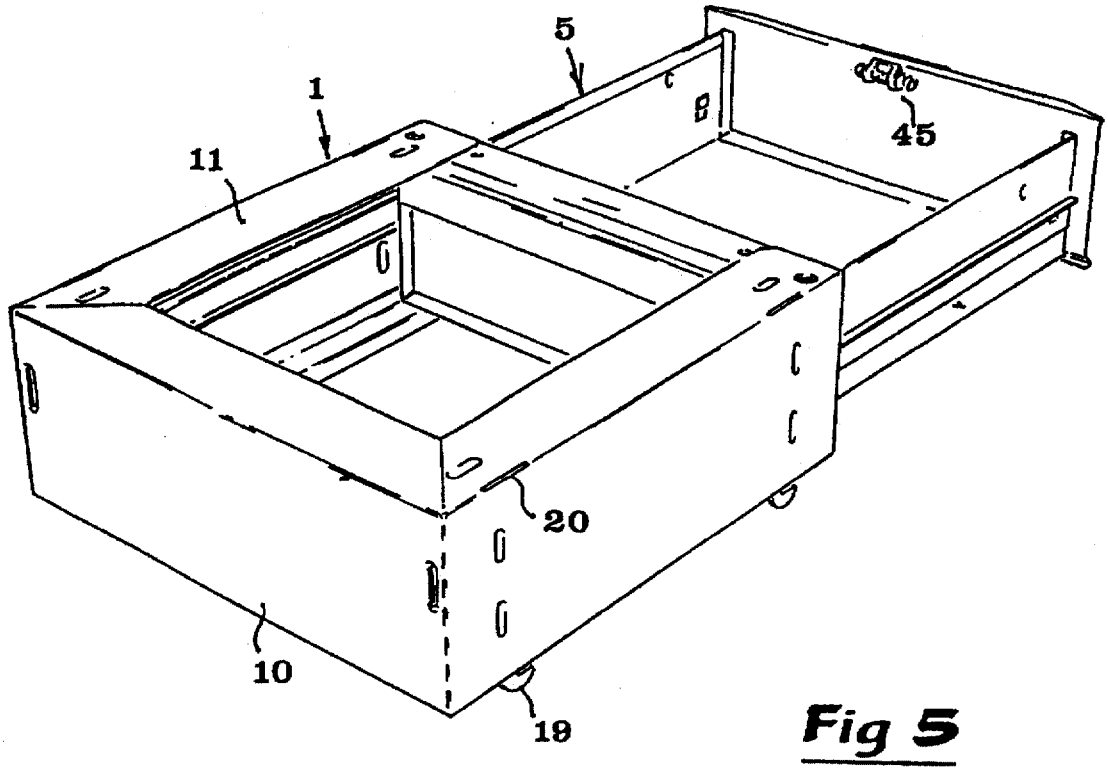
Figure 6:
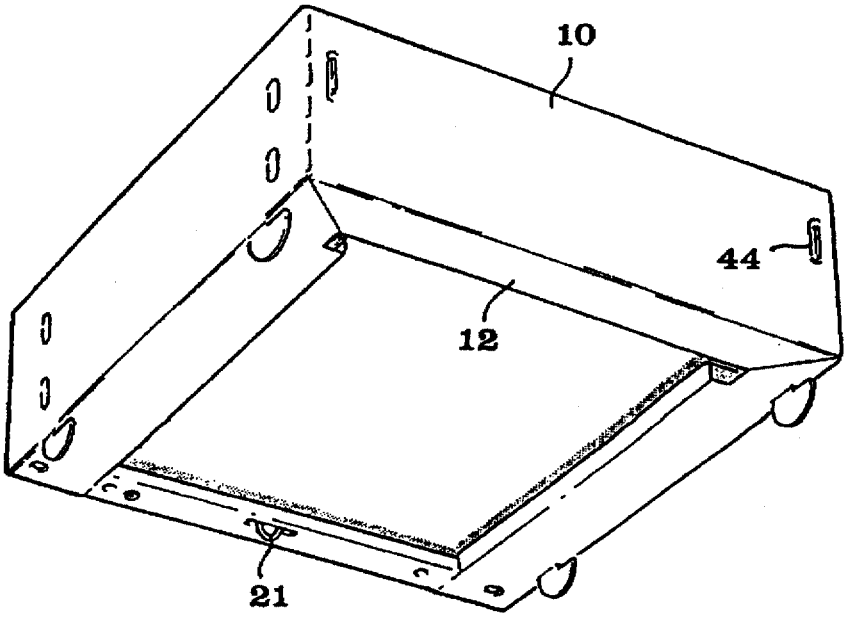

The guide rails illustrated in FIG. 4 are mounted in the following way. In a first step, drawer 5 is pulled out to an outer end position in which it is swung with its outer end upwardly, whereby the drawer is liberated from the cassette. The first rails 28,28' are mounted in the cassette 1 by bringing the rear end portions 32 of the rails into the holes 43 in the rear wall 10 of the cassette, whereafter tabs 35 are brought into engagement with holes 42' in sheet-metal tabs 42 by submitting the rails to a short, downwardly directed turning motion. Since holes 43, thanks to indentations 44, are located at a certain distance inside the main plane of the rear wall 10, the ends of webs 30 will not project out from the outside of rear wall 10. Each second guide rail 29,29' is placed on the outside of corresponding drawer side wall 25,25' by first submitting it to a longitudinal motion during which the tabs 38' are brought into engagement with corresponding holes in the side wall, and the hook-shaped tab 38 is brought into engagement with the corresponding hole by a short turning motion. After the rails 29,29' have been placed on the outsides of the drawer side walls, the drawer is again brought into the cassette; this being effected in analogy with the previously mentioned demounting, i.e., the drawer is turned from an initially oblique, upwardly-outwardly pointing position at which the upper edge of the rear part 26 of the drawer may be brought in beneath the upper part 13 of the frontal frame. When this has been accomplished, the drawer may be pushed into the cassette, each roller 40 belonging to the drawer being brought into engagement with and being guided by the upper and lower flanges 31' and 31, respectively, of the rails 28,28'. At the same time the upper flanges 37 of the rails 29,29' will rest against the rollers 34 which are located in the area of the front end of the cassette. Independently of the pulled-out position, the drawer will therefore always be supported on each side at two supporting points being distanced from each other along the down extension of the cassette, which supporting points are accomplished by the rollers 34 and 40, respectively. In its maximally pulled-out position, the drawer is withheld in the cassette by the upper edge of the rear part 26 of the drawer. In its completely pushed-in position, the drawer is locked by a lock 45 shown in FIG. 5.

I claim:

1. A cassette assembly for the construction of a drawer cabinet, the cassette assembly comprising on one hand a rectangular frontal frame (6) from which four walls extend, said four walls including a bottom wall (12), two side walls (9, 9') and an upper wall (11), and on the other hand a rear wall (10) to which said walls are connected, and which frontal frame (6) has substantially vertically positioned flanges (16), a drawer (5) in addition to a frontal part (23) comprising a bottom part (24), two side parts (25, 25') and a rear part (26) the height of which is greater than the height of the side parts (25, 25') so as to secure that an upper portion of the rear part engages behind an upper flange (16) of the frontal frame (6) and retains the drawer (5) in its position maximally pulled-out from the cassette assembly, the cassette assembly being prepared to comprise two pairs of guide rails (28, 28'; 29, 29') formed as supplements, each pair having a first rail (28, 28') with a substantially U-shaped cross-section which includes lower and upper flanges (31, 31') projecting from a vertically mounted web (30), and which first rail (28, 28') is on one hand at a rear end of the cassette assembly (1) connected to the rear wall (10), by a web end portion (32) inserted in a hole (43) in the rear wall (10) of the cassette assembly (1) and at a front end connected to the cassette assembly (1) in the vicinity of the frontal frame (6) thereof, and with the front end of which is fixedly connected a rotatable pulley or roller (34) located at a level beneath the lower flange (31) of U-shaped cross-section first rail (28, 28'), and a second rail (29, 29') which at opposed, front and rear ends is connected to one of said side parts (25, 25') of the drawer (5) by means of hook members (38, 38') inserted in holes (60) in said side part (25, 25') of the drawer, which second rail comprises a single longitudinal flange (37), said single longitudinal flange (37) projecting from an upper edge of a web (36) and arranged to abut against the roller (34) of the first rail (28,28'), a rotatable pulley or roller (40) fixedly connected to the rear end thereof, and arranged at a level above said single longitudinal flange (37) to engage between U-forming lower and upper flanges (31, 31') of the first rail, and that a tab (42) is punched out and bent-in in vertically positioned side part (15, 15') of the frontal frame (6), in which tab there is a hole (42') arranged to receive a hook (35) on the outside of the web (30) of the first rail (28, 28') so as to provide the connection between the side part (15,15') and the front end of said first rail (28, 28'), said tab (42) extending rearwardly from a recess (41) in the side part (15, 15') of the frontal frame, the form and size of which recess (41) substantially corresponding to the cross-sectional form and size of the first rail.

2. A guide rail kit having component parts capable of being assembled with (a) a cassette (1) and (b) a drawer (5) which slides in and out of said cassette (1) and is readily removable from and insertable into said cassette (1), the kit comprising the combination of two pairs of guide rails (28, 28'; 29, 29'), each pair having a first guide rail (28, 28') and a second guide rail (29,29'), said first guide rail (28,28') having a substantially U-shaped cross-section which includes lower and upper flanges (31, 31') projecting from a vertically mounted web (30), and which first guide rail (28,28') is on one hand at a rear end adapted to be connected to the cassette (1) in the vicinity of a rear wall (10) of said cassette (1), by a web end portion (32) adapted to be inserted in a hole (43) in the rear wall (10) of the cassette (1), and at a front end adapted to be connected to the cassette (1) in the vicinity of a frontal frame (6) of the cassette (1), and to the front end of the first guide rail (28,28') is fixedly connected a rotatable pulley or roller (34) located at a level beneath the lower flange (31) of U-shaped cross-section first guide rail (28,28'), and said second guide rail (29,29') which at opposed, front and rear ends is adapted to be connected to a side part (25,25') of the drawer (5) by means of hook members (38, 38') adapted to be inserted in holes (60) in said side part (25, 25') of the drawer, and which on one hand is limited to a single longitudinal flange (37), said single longitudinal flange projecting from an upper edge of a web (36) and adapted to abut against the roller (34) of the first guide rail (28,28'), and on the other hand a rotatable pulley or roller (40) fixedly connected to the rear end of said second guide rail (29,29') arranged at a level above said single longitudinal flange (37) and adapted to engage between U-forming lower and upper flanges (31,31') of said first guide rail, and a hook (35) on said web (30) of said first guide rail (28,28') which is adapted to be inserted in a hole (42') in a tab (42) punched out and bent-in in vertically positioned side part (15,15') comprised by the frontal frame (6) of cassette (1), so as to provide the connection between the cassette and the front end of said first guide rail (28,28'), said tab (42) extending rearwardly from recess (41) in the side part (15,15') of the frontal frame, the cross-sectional form and size of said first guide rail (28,28') substantially corresponding to the form and size of the recess (41).

3. A guide rail kit having component parts capable of being assembled with a cassette and a drawer which slides in and out of said cassette and is readily removable from and insertable into said cassette, the kit comprising the combination of two pairs of guide rails, each pair comprising a first guide rail and a second guide rail, said first guide rail having a substantially U-shaped cross-section which includes a lower flange and an upper flange projecting from a vertically mounted web, a rear end of said first guide rail adapted to be connected to the cassette in the vicinity of a rear wall of said cassette by an end portion of said vertically mounted web, and a front end of said first guide rail adapted to be connected to said cassette in the vicinity of a frontal frame of said cassette by a hook, a rotatable first pulley or roller located at a level beneath said lower flange and fixedly connected to said front end of said first guide rail, said second guide rail at opposed front and rear ends adapted to be connected to a side part of said drawer by means of hook members, said second guide rail having a single longitudinal flange projecting from an upper edge of a web of said second guide rail, said single longitudinal flange adapted to abut against said rotatable first pulley or roller, a second rotatable pulley or roller fixedly connected to a rear end of said second guide rail at a level above said single longitudinal flange and adapted to engage between said upper flange and said lower flange of said first guide rail.

* * * * *